United States Patent [19]

Thompson

[11] Patent Number: 4,750,344

[45] Date of Patent: Jun. 14, 1988

[54] WIRE DRAWING APPARATUS AND METHOD

[75] Inventor: Walter Thompson, Willowdale, Canada

[73] Assignee: Ceeco Machinery Manufacturing Limited, Concord, Canada

[21] Appl. No.: 794,079

[22] Filed: Nov. 1, 1985

[51] Int. Cl.[4] ..... B21C 1/12

[52] U.S. Cl. ..... 72/281; 72/280; 72/289

[58] Field of Search ..... 72/281, 280, 278, 274, 72/289, 279, 282, 288

[56] References Cited

U.S. PATENT DOCUMENTS

| | | | |
|---|---|---|---|
| 397,271 | 2/1889 | Bolton | 72/279 |
| 2,047,374 | 7/1936 | Larsen | 72/280 |
| 2,097,204 | 10/1937 | Beaman | 72/281 |
| 2,232,993 | 2/1941 | Berquist | 72/289 |
| 2,633,234 | 3/1953 | Kivley | 72/279 |
| 2,715,959 | 8/1955 | Zelley | 72/282 |
| 3,462,993 | 8/1969 | O'Grady | 72/281 |
| 3,811,312 | 5/1974 | Pietroni | 72/289 |
| 3,812,702 | 5/1974 | Benteler et al. | 72/282 |

FOREIGN PATENT DOCUMENTS 3106830 9/1982 Fed. Rep. of Germany ..... 72/281

*Primary Examiner*—Daniel C. Crane

*Attorney, Agent, or Firm*—Lilling & Greenspan

[57] ABSTRACT

Single and multi-wire drawing apparatus and method are described. A first wire drawing section includes two pairs of cone drawing blocks and two tandem drawing blocks. A second wire drawing section includes a number of tandem drawing blocks, four in the described embodiment, and a final capstan drawing block. the final tandem drawing block of the first wire drawing section is arranged on the second wire drawing section. All of the drawing blocks of the first wire drawing section are driven by a single drive, while the tandem and the final capstan drawing blocks on the second wire drawing section are actuated by a second drive. The dies associated with each tandem drawing block of the second section are movable so that a number of different wire sizes can be produced by appropriately moving the dies and adjusting the speed of the first drive to provide a desired wire speed entering into the second wire drawing section.

17 Claims, 4 Drawing Sheets

WIRE DRAWING APPARATUS AND METHOD

BACKGROUND OF THE INVENTION

The present invention generally relates to machines for drawing metal wire, for example, those used to manufacture wires to be bunched into conductors for flexible insulated cords, and more particularly to a wire drawing apparatus and method which facilitate changeovers to provide different wire reductions.

Wire drawing is an operation which is carried out in several passes, i.e. by passing the wire through a series of dies, the diameter of each of which is smaller than that of the preceding die. The wire is drawn through the dies by drawing capstans commonly referred to as "drawing blocks," the peripheral speeds of which increase progressively as the wire moves forward.

In one system of wire drawing which is used at present and is known as "wet wire drawing," the dies and, in some cases, the drawing blocks, are sprayed or immersed in a lubricating solution. Wire drawing machines can be divided into two classes, namely, in the single wire class which is more widely used at present, and the multi-wire class, the use of which is on the increase.

Wire drawing machines can also be divided into two different groups depending on the types of wire drawing blocks that are used. A first group of machines called "cone-type" wire drawing machines are characterized by drawing blocks of different diameters which are securely mounted on one and the same shaft to form a stepped cylinder or cone. The wire is looped around two sets of cones carried by a pair of spaced and substantially parallel shafts, and the dies are located in a die holder positioned in the path of the runs of wire between the two sets of cones. Wire drawing machines may comprise several pairs of cones, for example, two. This type of wire drawing machine offer the advantage of being very compact. On the other hand, the wire having the greatest diameter passes over the block having the smallest diameter, (i.e. the block providing the lowest speed). For certain types of applications this might not be satisfactory.

A second group of wire drawing machines have independent drawing blocks each mounted on a separate shaft. These machines are usually called "tandem" machines. The number of blocks is usually equal to the number of dies, with each die being upstream of its associated drawing block. The blocks, which in most applications have the same diameter, are driven at different speeds and the surface speed matches as closely as possible the difference in elongation between each die. The blocks may be positioned in many different arrangements, such as in-line, in a circle, along a spiral, etc. Generally, the wire can be strung along these blocks more easily than in the cone machines, but the drives are more complicated since a large number of blocks must all be driven at different speeds.

Multi-wire machines include both cone types and tandem type machines. Multi-wire machines with many configurations of cone and tandem blocks have been used in the art and they allow the drawing of several wires at the same time. At present eight wire machines are the most common.

All wire drawing machines are designed in such a way as to provide a pre-set difference in surface speed between successive blocks and this speed difference becomes a fixed parameter of the machine. The differences in surface speeds dictate the maximum reduction in area and the relative elongation of the wire from one block to the following one. At least in theory, the "reduction parameters" between successive drawing blocks can be arbitrarily assigned, the reduction parameters will establish the reductions in cross-sectional areas of the wires and, therefore, the percentages elongation of the wire between successive stages. This will dictate the speeds of the various drawing blocks, bearing in mind that while the physical dimensions of the wire between different drawing blocks changes, the total amount of material remains the same. In practice, the "reduction" parameters are not arbitrarily selected but are fixed by conventions in order to provide standard wire sizes. The standard wire sizes are also a function of the specific metals used to form the wires. For example, in the drawing of copper wires, a standard has been established in the United States designated the B & S American Wire Gauge (AWG). Under this convention, the wire gauges are assigned designations of 6/0 for the largest diameter wire to 56 for the finest wire. The ratio of the diameter of each gauge wire is approximately 0.89 to the diameter of the next or adjacent gauge wire. Having selected, for example, this B & S AWG standard for copper, the "reduction parameters" become defined and, at least in theory, the relative speeds of the various drawing blocks become known parameters. Working with the established ratios of diameters between adjacent or successive B & S AWG gauge wires, it is evident that the wire cross-sectional area must be reduced approximately 20.7% between successive drawing blocks, this resulting in elongations of the wires of approximately 26% per drawing stage. Therefore, in order to compensate for the increased length of the wire between successive drawing blocks, it is equally clear that each successive drawing block must exhibit a linear surface velocity of 126% of the linear surface velocity of the previous drawing block. The B & S AWG wire gauges is but one possible rule of action for a drawing machine. A different set of "reduction" parameters are used when drawing steel wire in accordance with, for example, the W & M steel wire gauge. Still other "reduction" parameters can be used for different materials, for example, aluminum.

In view of the fact that all blocks are usually linked by mechanical means in order to change the final diameter to be drawn, the complete string of dies has to be moved in the machine to modify the final diameter and this results in a big set-up time and loss of production.

With recent advances in electrical speed controlled drives, some wire drawing machines have been designed in such a way as to provide a separate motor and controls for the final block (normally called the "final capstan"). This system allows the user to change the speed of the final capstan in relation to the speed of the main machine, therefore, allowing the operator to match the speed of the final capstan to the next to the last drawing block. This allows the elimination of one die and an increase in the diameter of the final product without restringing. However, such systems reduce the output of the machine since the final speed of the product produced by the die upstream of the removed die is reduced by approximately 26% on a B & S drawing machine. Each time the wire gauge is decreased by one and the wire diameter increases, the linear velocity at the output of the machine decreases by approximately 26% with each removal of another die.

In view of the disadvantage of the aforementioned approach, it has been a common practice not to reduce the speed of the final capstan, but to increase the speed of the main machine to match the speed of the final capstan with the next to the last drawing block. With each next successively larger wire to be produced, (lower AWG gauge), the process is repeated and another drawing die is eliminated and the speed of the main machine is again increased by approximately 26%.

The last mentioned solution can provide some operating advantages, however, it can be immediately seen that this process has obvious limitations. For example, if we consider that the most commonly elongation for non-ferrous metal is 26%, by eliminating only two dies the main speed of the machine would have to be increased by 59%. In view of the fact that in state-of-the art equipment, the last shafts are already turning very close to the limits of existing bearing technology, these speeds cannot be exceeded and the number of diameters that can be produced without restringing is restricted to one or two. In order to avoid this problem, several means have been devised, the most commonly used being the use of clutches on the last shafts of this type of machine. This design allows the uncoupling of these shafts that are not used and would exceed the critical speeds if left connected with the drive system of the main machine, while the main machine speed is increased to match the final capstan surface velocity. Hence, this solution introduces complicated mechanisms and high maintenance items, such as clutches, couplings, etc.

SUMMARY OF THE INVENTION

The present invention comprises a new type of drawing machine and method in which the machine is separated into two sections each driven by a separate speed controlled drive. The first section or part of the machine may include cone sections, tandem blocks or both, and is arranged to reduce an incoming elongate metallic material to an intermediate wire of predetermined diameter which is greater than the diameters of a predetermined range of desired output production wire sizes. The speed of the drive for the first section can be changed to advance the output intermediate wire at adjustable preset speeds that can be selected depending on the mode of operation of the system.

The second part of the machine or section reduces the incoming wire of predetermined diameter from the first drawing section to a wire having a desired output diameter within said predetermined range. The second section includes any desired number of tandem blocks, normally 4 or more, and a final capstan drawing block all coupled to each other, and a plurality of interchangeable drawing dies each respectively positioned upstream of an associated drawing blocks. The drawing blocks and dies are dimensioned to provide predetermined changes in elongation and velocity following each reduction by a die. With four tandem blocks and a final capstan, the new configuration provides for great flexibility since the machine can produce five different diameters without requiring restringing by just eliminating one or more of the four dies comprised in the second tandem block section. A second drive is provided for driving the second wire drawing section at a selected second speed to provide the desired production of the output of the final capstan drawing block. If n tandem drawing blocks are provided in addition to the final capstan drawing block, n +1 different wire sizes within said predetermined range of desired output production wire sizes can be obtained by eliminating $n_i$ dies upstream of the final capstan drawing block, wherein $n_i$ is less than or equal n. In this instance, the remaining dies are advanced $n_i$ positions downstream and the speed of the first drive is selected to provide a first speed which corresponds at least to the velocity of the wire prior to the first reduction in the first die upstream of the $n_i + 1$ drawing block. The present invention can be applied to all slip wet wire drawing machines and does not require modification of established wire drawing practices, including slip characteristics.

In view of the fact that the speed of the last capstan of the first section is much slower than the final capstan, it is possible to increase the speed of the first section to match the speed of the capstan upstream of the first active capstan (the first capstan that pulls the wire through a die). This can be done for all the n +1 sizes (5 sizes where 4 tandem drawing blocks are provided) without restringing of the first section, and there is no need to use expensive and high maintenance clutches or couplings to disengage any of the unused shafts.

It is clear that depending on the requirements the first and second sections can be varied in design to provide the best mix of diameters that each user wishes to obtain. For example, the second section could be designed with six tandem capstan instead of five, thus allowing the user to produce seven diameters without restringing.

Furthermore, this configuration allows the production of wire sizes that fall between the diameters of the standard dies by just changing the dies in the second tandem section and adjusting the relative speed between the two sections to match the non-standard diameters that one wants to produce.

BRIEF DESCRIPTION OF THE DRAWINGS

The invention will be further described, by way of example, with reference to the accompanying drawings in which.

DETAILED DESCRIPTION OF THE PREFERRED EMBOIDMENTS

Figure 1:
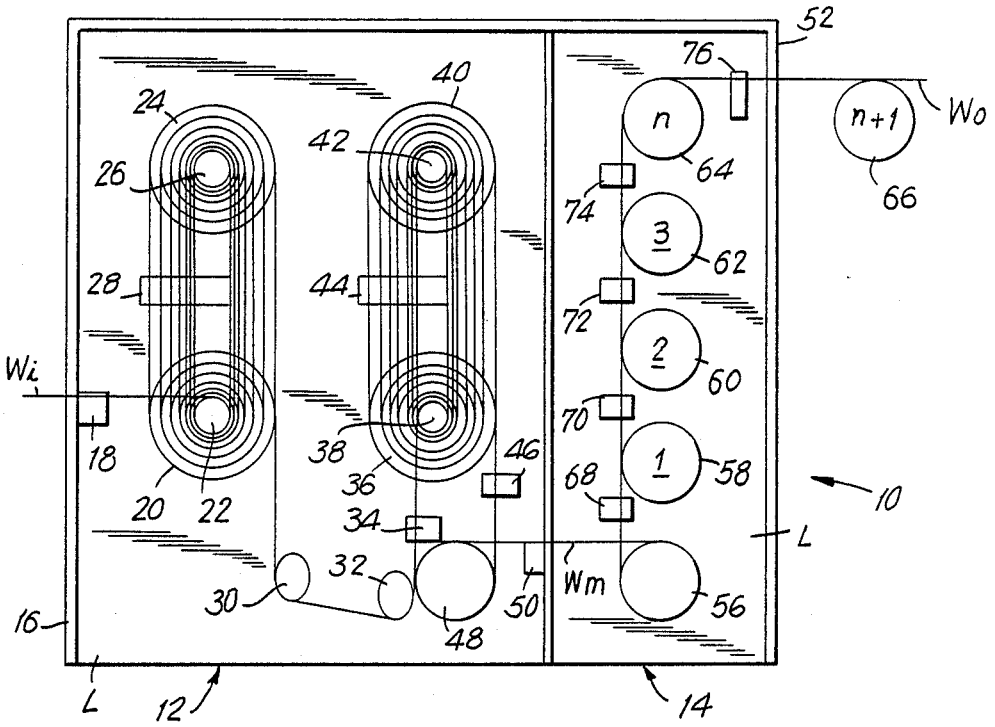
FIG. 1 is a schematic front elevational view of one embodiment of the wire drawing apparatus in accordance with the present invention, showing the two sections of the apparatus and the path of the drawn wire as it is reduced as a result of multiple passes through successively arranged dies.
Figure 2:
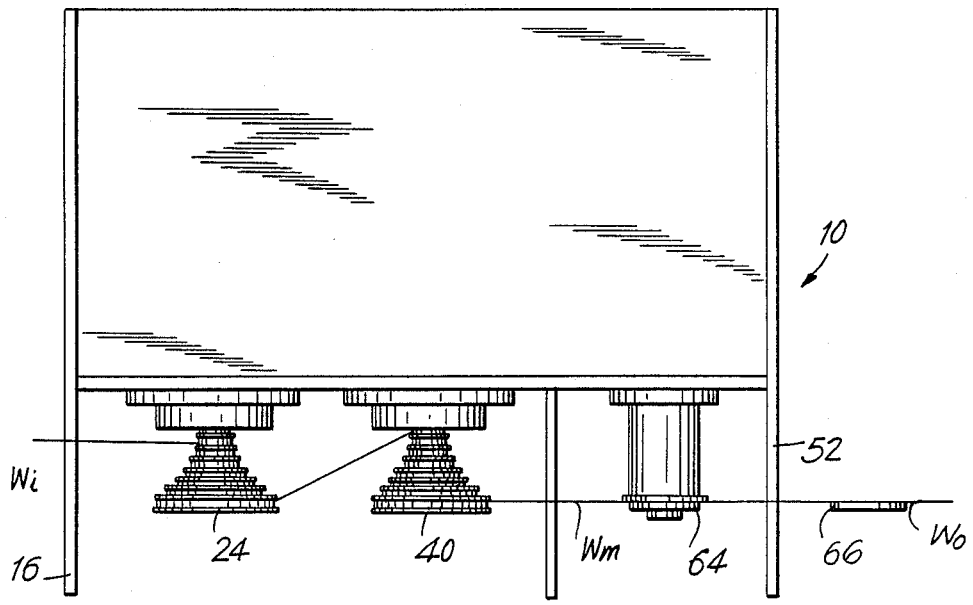
FIG. 2 is a top elevational view of the apparatus shown in FIG. 1.

Referring now specifically to the figures, in which identical or similar parts are designated throughout by the same reference numerals throughout, and first referring t FIGS. 1 and 2, there is schematically shown one presently preferred embodiment of a drawing machine in accordance with the present invention generally designated by the reference numeral 10.

The drawing machine 10 may be of the single wire class, as opposed to the multi-wire class machine to be more fully described in connection with FIGS. 5 and 6, although the machine 10 can be adapted to process two wires simultaneously.

In the discussion that follows, it will be assumed that the machine 10 is a B & S-type machine so that the "reduction" parameters of successive drawing stages follow the B & S copper AWG wire gauge standards, as discussed in the Background of the Invention. It will be obvious to those skilled in the art that minor modifications that need be made to the machine 10 should another wire gauge standard be adopted or required.

The drawing machine 10 has a first part or section 12 serially followed by a second part or section 14.

An incoming elongate metallic material, such as a heavy gauge wire $W_i$ enters the first section 12 through the housing 16 and is reduced by a series of drawing blocks and associated dies to an intermediate wire diameter $W_m$ which is greater than the diameters of a predetermined range of desired output production wire sizes. The intermediate diameter wire $W_m$ is advanced through a further series of reduction stages wherein the intermediate wire $W_m$ is reduced to a final output wire $W_0$.

The incoming elongate metallic material $W_i$ passes through an input die 18 and associated first cone drawing block 20 mounted for rotation with a shaft 22. A second cone drawing block 24 is mounted for rotation with a shaft 26, a die holder 28 being interposed between the drawing blocks 20 and 24 which support a plurality of dies positioned in the paths of movement of the wires extending between successive steps of the cone drawing blocks as shown and is well known to those skilled in the art.

Upon leaving the last step of the drawing block 24, the wire passes over idler rollers 30 and 32 and extends through a die 34 prior to engagement with a third cone drawing block 36 mounted for rotation with shaft 38. A fourth cone-type drawing block 40 mounted for rotation with shaft 42 cooperates with the third drawing block 36 and with a die holder 44 in a similar manner as described in connection with the first two drawing blocks 20 and 24. After leaving the last step of the fourth drawing block 40, the wire passes through a die 46 and engages its associated drawing block 48. As will be evident, all of the drawing blocks and dies mentioned thus far are all enclosed within the housing 16 of the first part or section 12 of the drawing apparatus. Prior to leaving the housing 16, the wire extends through a die 50 and thereupon exits the housing 16 and engages associated drawing block 56 arranged within the housing 52 of the second section 14.

Arranged downstream of the drawing block 56 are a series of tandem, serially arranged drawing blocks 58, 60, 62, 64 and a final capstan drawing block 66, each provided with associated dies 68, 70, 72, 74 and 76, respectively.

The drawing sections 12, 14 are "wet wire drawing" sections, and, therefore, they may be filled with a lubricating solution L or alternately, the dies and/or drawing blocks can be sprayed or otherwise lubricated. In almost any case, the dies 18 and 76 are advantageously sealing dies which seal the input and outlet openings of the containers 16 and 52 to prevent or minimize the escape of lubricating fluid therefrom.

As will become more apparent from the discussion that follows, the specific configuration or arrangement of drawing blocks and dies in the first section 12 is not critical for purposes of the present invention. Numerous known combinations of cone, tandem and/or combinations of such drawing blocks and dies can be used to reduce the incoming elongate metallic material $W_i$ to an intermediate or desired wire $W_m$ having a desired diameter or gauge. As will be discussed more fully in connection with FIGS. 4A–E, if the range of B & S wire gauges desire to be produced on the drawing apparatus includes AWG gauges 26–30, the intermediate wire $W_m$, in the embodiment shown, may be selected at AWG 25 wire gauge. If the wire gauge of the intermediate wire $W_m$ is selected at 12 AWG, the range of wire gauges which can be produced by the drawing apparatus includes wire gauges 13–17. Clearly, the drawing arrangements used in arriving at the intermediate wire gauge $W_m$ is not critical and is dictated by considerations of economy, size and other factors well understood by those skilled in the art.

The output die 76 is the last die prior to the final capstan drawing blocks 66 and is disposed within the housing 52 of the second section 14.

Figure 3:
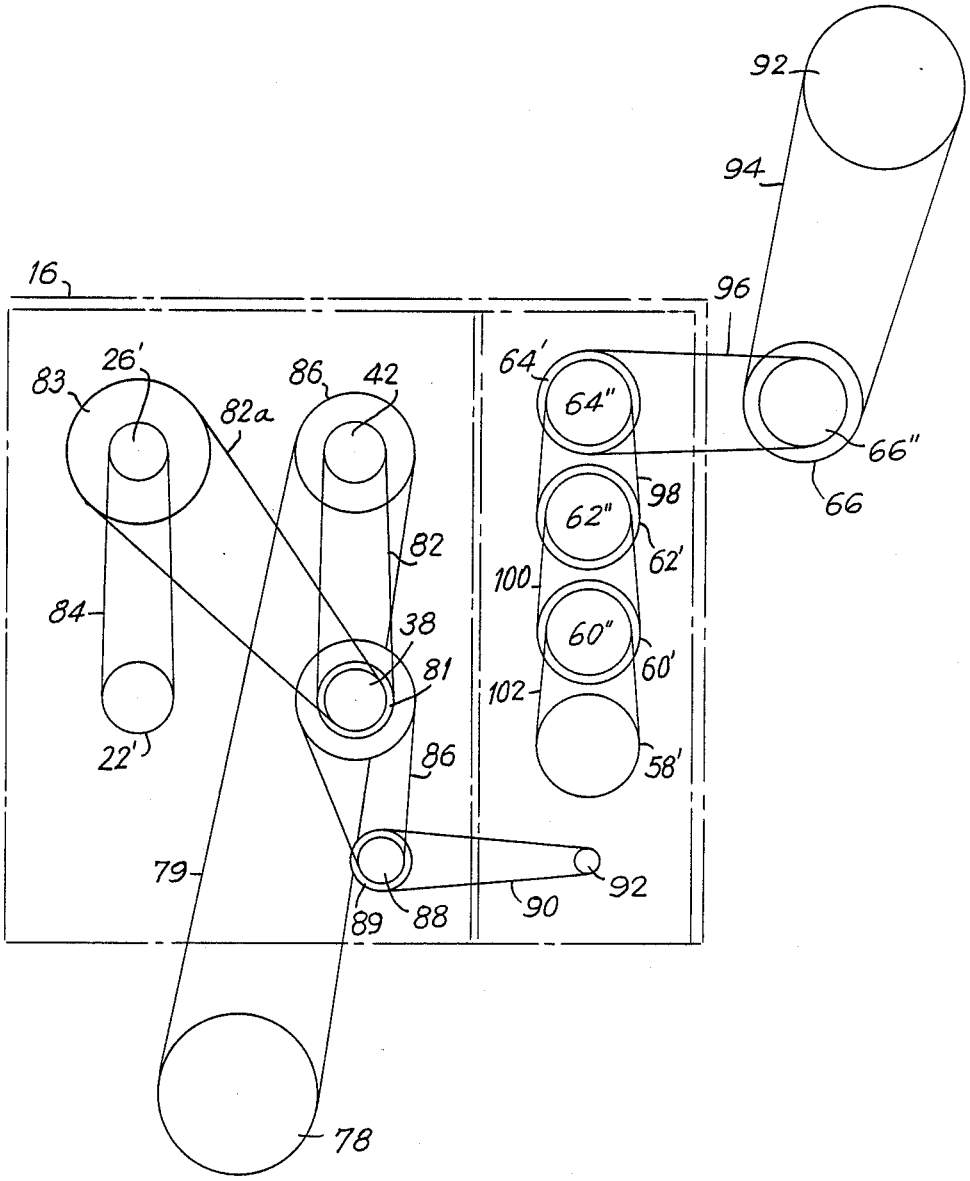
FIG. 3 is a schematic representation of the mechanical linkages, drives and gearings used to rotate the various shafts and drawing blocks as shown in FIGS. 1 and 2.

Referring to FIG. 3, an important feature of the invention is illustrated. A drive motor pulley 78 for the first section 12 is shown together with the various linkages, belts and gearings 79, 82, **82*a*, 84, 86 and 90, which engage associated pulleys, gears and sprockets 22', 26', 38', 42', 78, 81, 83, 86, 88, 89 and 92 as shown. This arrangement drives the first section drawing blocks, including the drawing blocks 20, 24, 36, 40, 48 and 56** to advance the intermediate wire $W_m$ at a selected first linear speed.

It will be evident, therefore, that once the various gearing ratios have been selected and the speed of the drive motor 78 has been established, this fixes the relative rotational speeds of the various shafts and drawing blocks which comprise the first drawing section or part of the machine.

The remainder of the drawing blocks 58, 60, 62, 64 and 66 are all linked to, directly or indirectly, and controlled by a second section drive motor pulley 92 which can, for example, utilize a drive belt 94 to engage a pulley 66' mounted on the shaft carrying the final capstan 66, with belts 96, 98, 100 and 102 being used to couple the successive drawing blocks via pulleys of appropriate diameters 66'', 64', 64'', 62', 62'', 60', 60'' and 58'. As will be more fully described, the motor pulley 92 of the second section can be advantageously adjusted at a selectible second speed to provide the desired production at the output of the final capstan drawing block 66. The speed of the motor pulley 78 of the first section, on the other hand, can advantageously be modified to establish the required linear velocity of the intermediate wire $W_m$ needed to provide the necessary reductions with all the drawing blocks and dies in place as shown in FIG. 1 or with one or more drawing blocks and dies removed as will be described in connection with FIGS. 4–4E.

Referring to FIGS. 1-3 and 4A, the operation of the drawing machine 10 will first be described under the conditions of maximum wire reductions within the capability of the machine with a given set of dies in place. As suggested, in a B & S type drawing machine, each successive reduction by a die requires an increase in linear velocity at the output of that die of about 26%. In the embodiment shown, wherein five possible reductions can take place within the second section 14, there is approximately a 300% increase in speed of the linear velocity of the output wire $W_o$ in relation to the intermediate wire $W_m$.

Figures 4A, 4B, 4C, 4D, 4E:
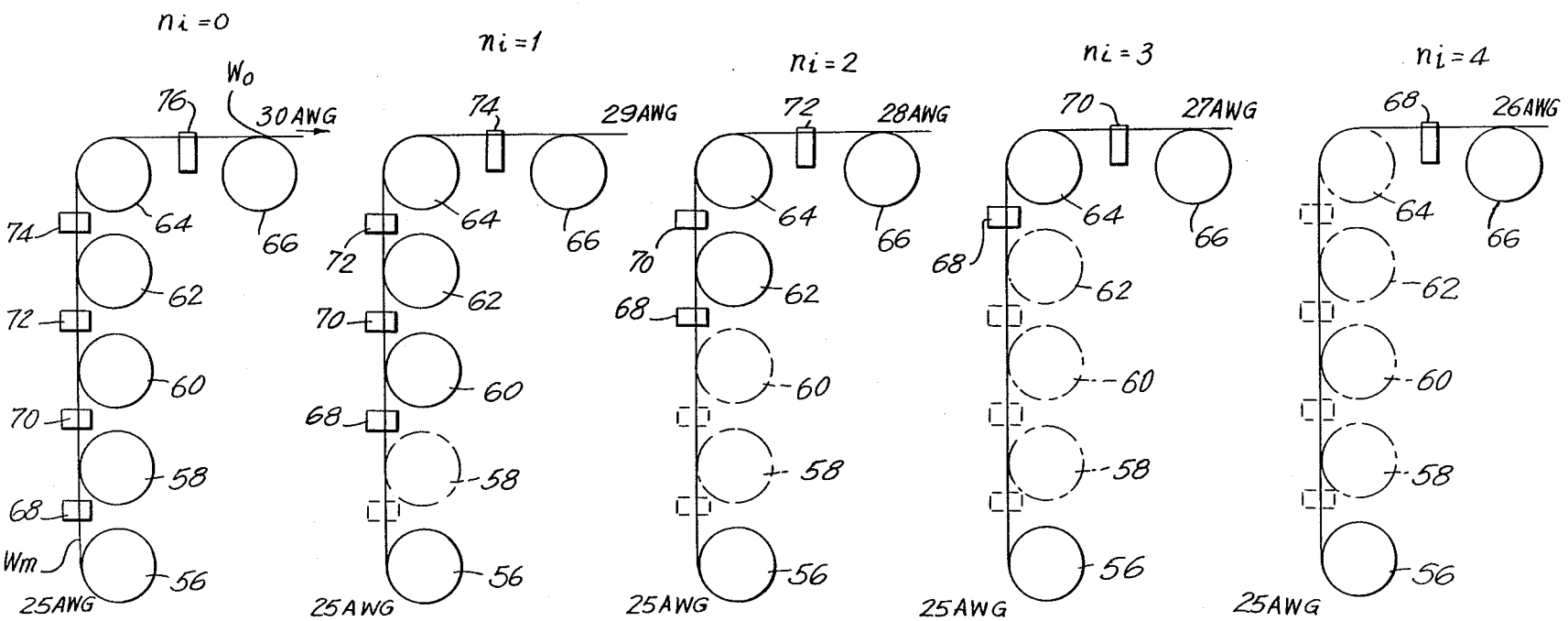
FIGS. 4A–E are schematic representations of the last drawing block of the first section, the tandem drawing blocks of the second section and the final capstan drawing block, illustrating, respectively, the manner in which successively heavier gauges of wire can be produced in accordance with the present invention by the elimination of drawing blocks and dies and the movement of the dies in order to maintain uniform wire gauge inputs into the second section and wire outputs at each gauge produced by the drawing machine.

In FIG. 4A, the intermediate wire $W_m$ entering the first die 68 in the second section 14 is a 25 gauge wire. Assuming that the normalized linear velocity of the wire $W_m$ in FIG. 4 is equal to 1, the normalized velocity of the output wire $W_0$ is approximately 3.18. The output of the dies 68, 70, 72, 74 and 76 are wire gauges 26, 27, 28, 29 and 30, respectively.

The advantages of the present invention can best be appreciated from an examination of FIGS. 4B-E. In order to produce the next higher diameter gauge, namely, 29 gauge wire, the die preceding and associated with the final capstan drawing block 66 is removed or eliminated, and the remaining drawing blocks are advanced one position downstream so that the dies 68, 70, 72 and 74 are now respectively associated with the drawing blocks 60, 62, 64 and 66. However, since one reduction has been eliminated, in order to maintain the same normalized linear velocity of 3.18 at the output of the final capstan drawing block, the speed of the first section motor pulley 78 is increased to increase the rotational velocities of the various linked or coupled elements so that the last drawing block 56 which forms part of the first section is increased by a factor of 1.26 or by 26%. At this higher rotational speed, the 25 gauge wire can be advanced to the first die 68 at a sufficiently high speed to compensate for the elimination of the one reduction and thereby maintain the linear velocity of the output wire $W_o$.

Similarly, referring to FIGS. 4C-E, 2, 3 or 4 dies (76 and 74; 76, 74 and 72; and 76, 74, 72 and 70, respectively) are removed and the remaining dies likewise advanced downstream as previously suggested. In the configuration shown in FIG. 4C, the speed of the motor pulley 78 is adjusted to provide a normalized velocity of the drawing block 56 to 1.59, a normalized velocity of 2.00 in FIG. **4*d* and a normalized velocity of 2.52 in the configuration shown in FIG. 4E**. It will be noted, therefore, that the gauge of the intermediate wire $W_m$ is the same in each configuration, namely, 25 gauge in the embodiment described. The wire gauge can be modified within a given range to select anyone of a number of different wire gauges, in the example, wire gauges 26-30. The selection of wire gauges within a predetermined or desired range is achieved by increasing the velocity of the rotating components in the first section which is initially low as compared to the output velocities of the second stage. The increase in velocity of the first section does not, therefore, present a problem insofar as the capabilities of the bearings and rotating elements are concerned.

Similarly, it is possible to run ½ sizes. For example, if the machine was initially set up to run 30 AWG gauge wire, different gauge sizes can be produced by increasing to the linear velocity of the drawing block 56 as above described. Typically, if gauge 29½ gauge wire is to be produced, the producer would normally create an entire series of ½ sizes. Thus, for one to produce a 29½ gauge wire, the drawing machine should have the capability of also producing 28½, 27½, etc. gauge wires, all within the same predetermined or desired ranges within the capability of the machine. To produce a series of ½ sizes is equally possible with the present invention as whole sizes. The only difference would be to initially increase the linear velocity of the drawing capstan 56 by 13 (a factor of 1.13) instead of imparting an initial change in the speed of 26%. The first die following the drawing capstan 56 would, of course, be ½ gauge size. Now, by again imparting increases of 26% in linear velocity between successive stages, entire or whole gauge reductions take place so that if the first reduction becomes a ½ size, successive wire sizes will also be ½ sizes, e.g. 25½, 26½, 27½, etc. As will be appreciated, therefore, the creation of ½ sizes is equally as simple, convenient and inexpensive as it is to modify whole sizes. All that is required is a difference in initial selection of the velocity of the last drawing block of the drawing block 56 of the first section.

Figure 5:
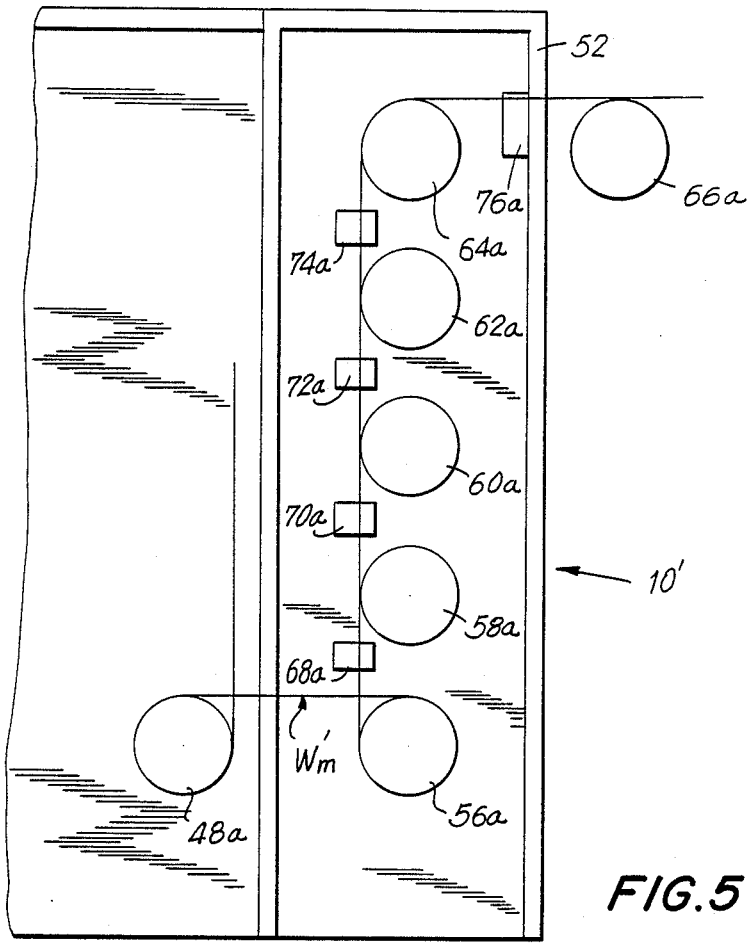
FIG. 5 is an enlarged front elevational view similar to FIG. 1, broken away to show the application of the present invention to a multi-wire drawing machine.
Figure 6:
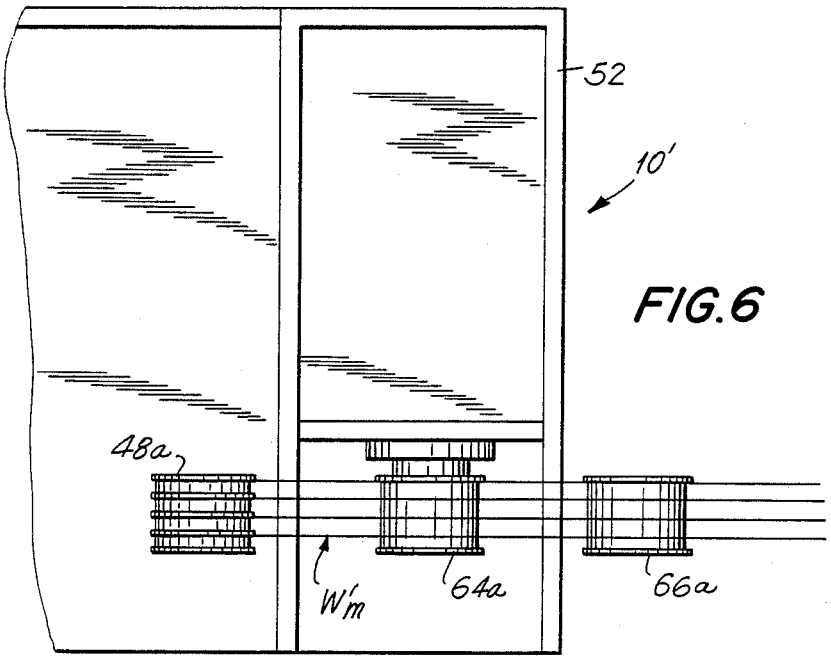
FIG. 6 is a top elevational view similar to FIG. 2 and showing the details of the multi-wire drawing machine of FIG. 5.

Referring to FIGS. 5 and 6, a multi-wire system is shown which operates, and all essential features, in the way described above in connection with the single wire system. The only difference, of course, is that multiple wires are guided simultaneously and adjacently to each other on drawing blocks **48*a*, 56*a*, 58*a*, 60*a*, 62*a*, 64*a* and 66*a*, each being reduced by its own associated dies 50*a*, 68*a*, 70*a*, 72*a*, 74*a* and 76*a***. The modifications to the previously described embodiment would be well within the capabilities of those skilled in the art.

The increases in efficiency in the use of the wire drawing apparatus and method of the present invention can best be illustrated by a few simple calculations. For example, on a typical wire drawing machine set up to produce a single 30 AWG gauge wire, it presently takes approximately 30 minutes to restring the machine to produce a different gauge wire. Assuming an eight hour working day and assuming two wire size changes or restringings of the machine in one day, the down time of the machine is 60 minutes out of an eight hour day. With the subject apparatus and method, the same change in wire size can be effected within approximately five minutes. There is, therefore, a saving of 50 minutes per day of down time, and this represents approximately a 12% increase in efficiency in the running time of the machine. While the aforementioned increase is significant, the efficiencies which can be obtained in restringing multiple wire machines is even more dramatic. For example, in an eight wire machine it typically takes approximately four hours to restring a conventional eight wire machine. Using the eight hour day as a base, this means that the machine is down a full 50% of the day for only one restringing of the machine. With the subject apparatus and method, to modify a gauge size on an eight wire machine it takes only approximately 20 minutes. This represents approximately a 92% increase in the running time over a conventional multi-wire machine. Some eight wire machines have been known to require as much as eight hours for a restringing. This means that, for such machine, production ceases for an entire working day to effect a single restringing operation. Again, that same modification to the subject wire drawing apparatus method would require only approximately 20 minutes. It will be immediately evident, therefore, that the subject wire drawing apparatus and method not only facilitates and makes more convenient the modifications of wire drawing machines to produce different wire gauge sizes, but the invention results in significant increases in efficiency and effectively eliminates down time so that producers of wire can produce different wire gauges in any desired quantities without suffering major set backs in operational efficiencies.

While the invention is described with reference to specific embodiments thereof and with respect to the incorporation therein of certain combinations of features, it is to be understood that the invention may be embodied in other forms, many of which do not incorporate all of the features present in this specific embodiment of this invention which has been described. For this reason, the invention is to be taken and limited only as defined by the claims that follow.

What is claimed is:

1. Wire drawing apparatus comprising:

(a) a first wire drawing section comprising a plurality of dies for reducing an incoming elongate metallic material to an outgoing intermediate wire of predetermined diameter which is greater than the diameters of a predetermined range of desired output production wire sizes;

(b) first drive means for driving said first wire drawing section to advance the outgoing intermediate wire at an adjustable first linear speed;

(c) a second wire drawing section for receiving and selectively reducing the intermediate wire of predetermined diameter from said first wire drawing section to an output wire having a desired final diameter within said predetermined range, said second wire drawing section including n tandem drawing blocks and a final capstan drawing block all coupled to each other, and a plurality of $n+1$ interchangeable drawing dies each respectively positioned upstream of an associated drawing block, said drawing blocks and dies being dimensioned to provide predetermined changes in elongation and velocity following each reduction by a die;

(d) second drive means for simultaneously driving said n and final capstan drawing blocks on said second wire drawing section at a selectable substantially constant second speed to provide a desired production rate at the output of said final capstan drawing block for a predetermined range of wire sizes; and (e) means for independently adjusting the speeds of said first and second drive means, whereby elimination of $n_i$ dies upstream: of said final capstan drawing block and the advance of the remaining dies $n_i$ positions downstream in said second wire drawing section permits production of $n+1$ different output wire sizes within said predetermined range of desired output production wire sizes when said first and second drive means are adjusted to cause the speed of the outgoing intermediate wire outputted from said first wire drawing section to correspond to the velocity of the wire prior to the first reduction in the first die upstream the $n_i+1$ drawing block, wherein $n_i \leqq n$ and wherein $n \geqq 1$, and whereby a substantially constant output production at said final capstan drawing block can be achieved for different output wire sizes without exceeding the speed limits of said wire drawing sections.

2. Wire drawing apparatus as defined in claim 1, wherein said first wire drawing section includes at least one pair of cone drawing blocks.

3. Wire drawing apparatus as defined in claim 2, wherein two pairs of cone drawing blocks are provided.

4. Wire drawing apparatus as defined in claim 2, further comprising at least one tandem drawing block.

5. Wire drawing apparatus as defined in claim 4, wherein two tandem drawing blocks are provided.

6. Wire drawing apparatus as defined in claim 4, wherein said at least one tandem drawing block is arranged downstream of said at least one pair of cone drawing blocks.

7. Wire drawing apparatus as defined in claim 1, wherein said first wire drawing section includes at least one tandem drawing block.

8. Wire drawing apparatus as defined in claim 1, wherein $n=4$.

9. Wire drawing apparatus as defined in claim 1, wherein said first wire drawing section includes a technical drawing block driven by said first drive means and arranged on said second wire drawing section.

10. Wire drawing apparatus as defined in claim 9, wherein said terminal drawing block is a tandem drawing block.

11. Wire drawing apparatus as defined in claim 1, wherein the wire drawing apparatus is a multi-wire machine, and wherein said first and second wire drawing sections include drawing blocks and dies for processing multiple wires simultaneously.

12. Wire drawing apparatus as defined in claim 1, wherein $n=4$ and $n_i=0$.

13. Wire drawing apparatus as defined in claim 1, wherein $n=4$ and $n_i=1$.

14. Wire drawing apparatus as defined in claim 1, wherein $n=4$ and $n_i=2$.

15. Wire drawing apparatus as defined in claim 1, wherein $n=4$ and $n_i=3$.

16. Wire drawing apparatus as defined in claim 1, wherein $n=4$ and $n_i=4$.

17. Wire drawing method comprising the steps of:

(a) reducing, in a first wire drawing section, an incoming elongate metallic material to an intermediate wire of predetermined diameter which is greater than the diameters of a predetermined range of desired output production wire sizes;

(b) driving said first wire drawing section to advance the intermediate wire at a selectable first linear speed;

(c) receiving and selectively reducing, in a second wire drawing section, the wire or predetermined diameter from said first drawing section to a wire having a desired output diameter within said predetermined range, providing n tandem drawing blocks in said second wire drawing section providing a final capstan drawing block coupled to said tandem drawing blocks, and providing a plurality of $n+1$ interchangeable drawing dies each respectively positioned upstream of an associated drawing block, said drawing blocks and dies being dimensioned to provide predetermined changes in elongation and velocity following each reduction by a die; and (d) driving said second wire drawing section at a selectable second speed to provide the desired production at the output of said final capstan drawing block, whereby $n+1$ different wire sizes within said predetermined range of desired output production wire sizes can be obtained by eliminating $n_i$ dies upstream of said final capstan drawing block, advancing the remaining dies $n_i$ positions downstream and adjusting said first drive means to provide a first speed which corresponds to the velocity of the wire prior to the first reduction in the first die upstream the $n_i+1$ drawing block, wherein $n_i \leqq n$ and wherein $n \geqq 1$.

* * * * *